US006889455B2

(12) United States Patent
Giraud

(10) Patent No.: US 6,889,455 B2
(45) Date of Patent: May 10, 2005

(54) METHOD OF INCORPORATING A PROMOTIONAL ITEM INTO A DUAL WALL CUP

(75) Inventor: Jean Pierre Giraud, Paris (FR)

(73) Assignee: Capitol Cups, Inc., Amsterdam, NY (US)

( * ) Notice: Subject to any disclaimer, the term of this patent is extended or adjusted under 35 U.S.C. 154(b) by 0 days.

(21) Appl. No.: 10/301,428

(22) Filed: Nov. 21, 2002

(65) Prior Publication Data

US 2004/0055189 A1 Mar. 25, 2004

Related U.S. Application Data

(60) Provisional application No. 60/331,950, filed on Nov. 21, 2001.

(51) Int. Cl.[7] ..... G09F 03/00
(52) U.S. Cl. ..... 40/324
(58) Field of Search ..... 40/324; 215/382

(56) References Cited

U.S. PATENT DOCUMENTS 3,302,813 A * 2/1967 Schaich ..... 220/4.21
3,341,644 A * 9/1967 Allen ..... 264/550
5,275,277 A * 1/1994 Gallegos ..... 206/217

* cited by examiner

*Primary Examiner*—Joanne Silbermann
(74) *Attorney, Agent, or Firm*—Greenberg Traurig, LLP

(57) ABSTRACT

The present invention is directed to a dual wall cup assembly suited for use in a promotional campaign, provided with an outer cup having a sidewall joined to a bottom wall and provided with an open top; an inner cup having a sidewall joined to a bottom wall and provided with an open top; the inner cup is configured to be receivable within the outer cup to create a sealed gap between the side walls of an inner surface of the outer cup and an outer surface of the inner cup and between the bottom walls of the outer and inner cups; and a promotional item positioned within the gap.

15 Claims, 6 Drawing Sheets

FIG. 7a
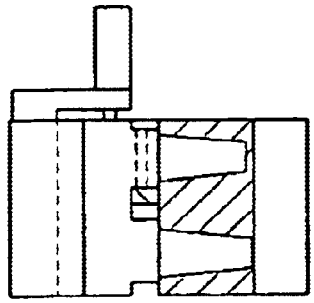
FIG. 7b
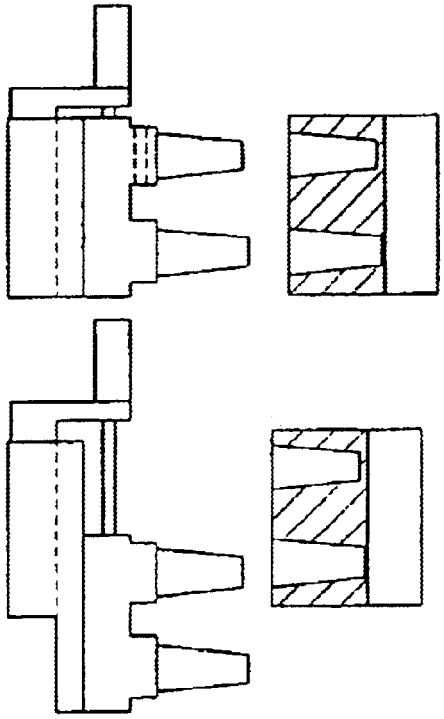
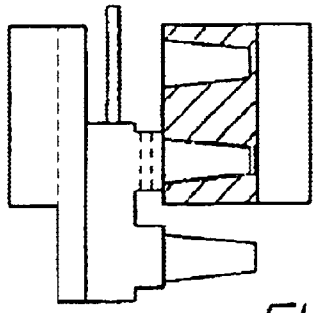
FIG. 7c
FIG. 7d
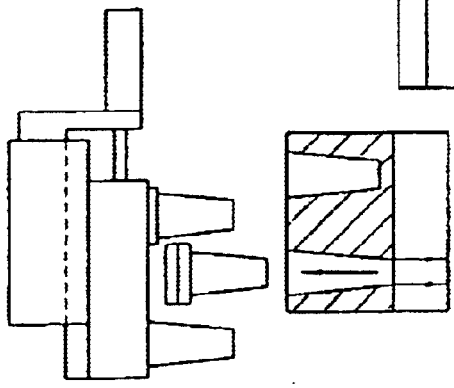

METHOD OF INCORPORATING A PROMOTIONAL ITEM INTO A DUAL WALL CUP

IDENTIFICATION OF RELATED APPLICATION(S)

The present application is entitled to the benefit of the filing date of U.S. Provisional Patent Application No. 60/331,950 filed Nov. 21, 2001.

BACKGROUND OF THE INVENTION

Retailers often use promotional activities to increase the sales of their products. For instance, in the quick-service restaurant industry, restaurants often employ promotional items such as games in which the customer can receive instant prizes and/or collect game pieces in an effort to earn prizes. Such games commonly use game pieces which consumers either immediately return or collect and return for prizes (e.g, free beverages or food).

Traditionally, quick-service restaurants have delivered such game pieces to their customers in one of two ways. In connection with some prior promotions, restaurants have handed the games pieces to the patron upon completing the sale. Food and beverage containers have also been used to convey game pieces. In one existing form, a game piece consists of a flexible paper tab which is adhered to the side of a container (e.g., a cup). The game piece thus readily conforms to and smoothly lies over either a planar or non-planar surface of the container. The game pieces are designed to be peeled off the surface to reveal the prize won by the patron or to convey other information to the patron.

Inflexible promotional items such as game pieces and prizes do not generally conform to the surfaces of food and beverage containers. Thus, restaurants have traditionally distributed such game pieces apart from the containers. Quick-service restaurants, however, generally disfavor separate distribution because they cannot ensure that every customer receives a game piece with his or her purchase. Decoupling the game piece from the container can also present the risk that game pieces will be distributed without a product purchase.

In addition, there are numerous containers presently being used to hold hot or cold foods. For example, such containers include cups that are being used to feed liquids to children. One example of such cups are cups that contain covers to minimize spilling by children and are typically known as "spill-proof cups." These "spill-proof cups" are typically used by children under the age of five. Typically, these cups are injection molded of high density polyethylene ("HDPE") and are composed of a cup body and a removable screw-top or comparable lid. In use, the child typically places his/her lips around the spout, tilts the cup up and sucks out the liquid volume.

Another example of a container used to hold hot or cold foods (e.g. beer, coffee, tea and/or soda) is a mug or cup. For example, recent years has seen a considerable upsurge in the popularity of so-called "travel mugs". A typical travel mug includes a container for a beverage and is fitted with a removable cover. Conventionally, the cover will be provided with a mouthpiece or an opening of limited size through which the beverage may be withdrawn by the user of the mug. This configuration allows considerable sloshing of the beverage within the mug without spilling because the limited size of the opening through the cover or the mouthpiece is such as to substantially confine all of the liquid. In one specific embodiment, the opening may be at the bottom of a recess in the cover. Thus, to the extent that a beverage may pass through the opening to the exterior of the mug and remain in the recess, it will drain back into the mug, again preventing the spilling of the beverage. In addition, the "travel mug" may be advertised as having insulation abilities.

Moreover, containers are also presently being used for drinking glasses for containing cold or hot drinks. Other containers are presently being used to handle hot liquids such as hot beverages, soup, and the like. These type of containers are presently being used in large quantities in the fast food and other industries requiring disposable containers.

SUMMARY OF THE INVENTION

In one embodiment, the present invention relates to a fully automatic method of incorporating a promotional item into a dual wall cup. In another embodiment, the placement of the promotional item into the cup and the overall cup assembly is performed in the mold. The present invention also relates to methods of accessing the promotional item in the container by the consumer. In a further embodiment, the present invention includes features in the container that can render the container substantially unusable after the promotional item is removed. For purposes of the present invention, it is understood that the term "cup," "container" and/or "mug" is used interchangeably and will refer to the same device.

The present invention utilizes a dual wall cup assembly, that is an assembly provided with an inner and an outer cup. In one embodiment, the dual wall cup assembly has insulating ability by having at least a "dual" structure wherein an inner cup, in one embodiment, is given a different taper than an outer cup to form an insulating air layer or gap between the inner and outer cup. The insulated dual wall cup of the present invention results in numerous advantages for the insulated container that (a) is thermally insulating for comfortable handling and for maintaining the temperature of its contents, (b) is sturdy enough to withstand prolonged handling, (c) can be made of biodegradable and recyclable materials, (d) is inexpensive to manufacture, and (e) has good insulating properties. The present invention may be used in the applications, which were discussed above in the background of the invention, including cups that are being used to feed liquids to children; mugs to hold hot or cold beverages; and containers that are used to handle hot liquids such as hot beverages, soup, and the like (e.g. "fast food" or "quick service" providers).

In one embodiment, a cup assembly having an open end, comprising: (a) a dual wall cup assembly comprising: (i) an outer cup having a truncated conical-like shape with side wall, larger top and smaller end, the end is closed and sealed by bottom wall and the top is open; (ii) an inner cup having a truncated conical-like shape with side wall, larger top and smaller end, the end is closed and sealed by bottom wall; and (iii) the inner cup is configured to be receivable within the outer cup to create a gap between side wall of an inner surface of the outer cup and an outer surface of the inner cup and between the bottom walls. The promotional item is located with this gap.

In yet another embodiment the dual wall cup assembly is provided with an outer cup having a sidewall defining first and second truncated cone-shaped portions that are joined by a sidewall segment, the sidewall joined to a bottom wall and provided with an open top, an inner cup having a sidewall defining first and second truncated cone-shaped portions that are joined by a sidewall segment, the sidewall joined to a bottom wall and provided with an open top, and a promotional item positioned within the gap.

In a specific embodiment, the gap of the dual wall cup assembly is positioned between at least one of the sidewalls of the first truncated cone-shaped portion of the inner cup and the first truncated cone-shaped portion of the outer cup; the sidewalls of the second truncated cone-shaped portion of the inner cup and the second truncated cone-shaped portion of the outer cup; and the bottom wall of the inner cup and the bottom wall of the outer cup.

In a more specific embodiment, the gap of the dual wall cup assembly is positioned between all of the sidewalls of the first truncated cone-shaped portion of the inner cup and the first truncated cone-shaped portion of the outer cup; the sidewalls of the second truncated cone-shaped portion of the inner cup and the second truncated cone-shaped portion of the outer cup; and the bottom wall of the inner cup and the bottom wall of the outer cup.

BRIEF DESCRIPTION OF THE DRAWINGS

FIG. 6B is an enlarged, fragmentary vertical sectional view of the cup assembly taken approximately along the line 2—2 in FIG. 6A; and FIG. 7 is a schematic of a process of forming the cup assembly according to one embodiment of the present invention.

DETAILED DESCRIPTION OF THE EMBODIMENT(S)

In one embodiment, the present invention relates to a fully automatic method of incorporating a promotional item into a dual wall cup. In another embodiment, the placement of the promotional item into the cup and the overall cup assembly is performed in the mold. The present invention also relates to methods of accessing the promotional item in the container by the consumer. In a further embodiment, the present invention includes features in the container that can render the container substantially unusable after the promotional item is removed. For purposes of the present invention, it is understood that the term "cup," "container" and/or "mug" is used interchangeably and will refer to the same device.

The present invention utilizes a dual wall cup assembly, that is an assembly provided with an inner and an outer cup. In one embodiment, the dual wall cup assembly has insulating ability by having at least a "dual" structure wherein an inner cup, in one embodiment, is given a different taper than an outer cup to form an insulating air layer or gap between the inner and outer cup. The insulated dual wall cup of the present invention results in numerous advantages for the insulated container that (a) is thermally insulating for comfortable handling and for maintaining the temperature of its contents, (b) is sturdy enough to withstand prolonged handling, (c) can be made of biodegradable and recyclable materials, (d) is inexpensive to manufacture, and (e) has good insulating properties. The present invention may be used in the applications, which were discussed above in the background of the invention, including cups that are being used to feed liquids to children; mugs to hold hot or cold beverages; and containers that are used to handle hot liquids such as hot beverages, soup, and the like (e.g. "fast food" or "quick service" providers).

In one embodiment, a cup assembly having an open end, comprising: (a) a dual wall cup assembly comprising: (i) an outer cup made of a thermoplastic material with a side wall, a top and an end, the end is closed and sealed by a bottom wall and the top is open; (ii) an inner cup made of a thermoplastic material with a side wall, a top and an end, the end is closed and sealed by a bottom wall; and (iii) the inner cup is configured to be receivable within the outer cup to create a sealed gap between the side walls of an inner surface of the outer cup and an outer surface of the inner cup and between the bottom walls of the outer and inner cups. The promotional item is located with this gap.

Figure 1:
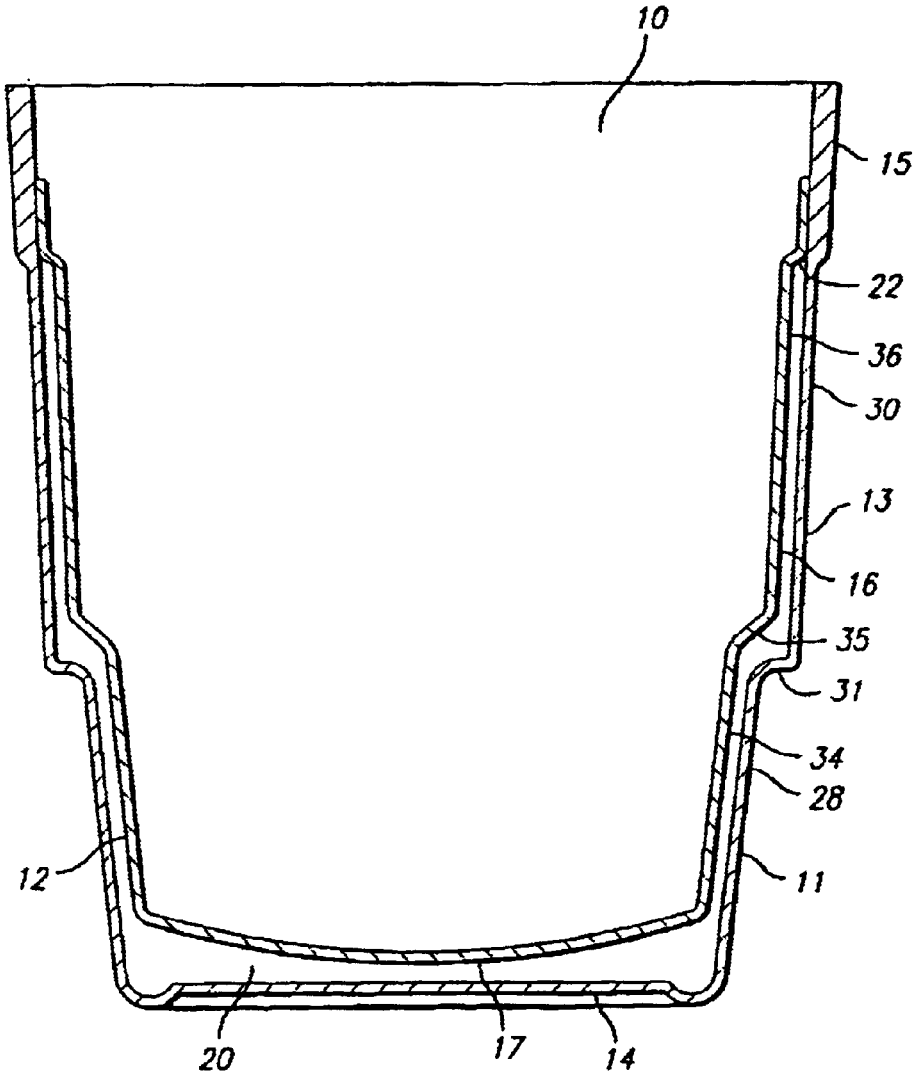
FIG. 1 is a vertical sectional cut-away view of one embodiment of the dual wall container of the present invention.

FIG. 1 shows a cross-section of a one embodiment of the present invention. Specifically, there is a cup assembly 10 comprised of an outer cup 11 and an inner cup 12. Outer cup 11 has sidewall 13 defining first and second truncated cone-shaped portions 28, 30 that are joined by a sidewall segment 31, the sidewall 13 joined to a bottom wall 14 and provided with an open top 15. Inner Cup 12 is provided with a sidewall 16 defining first and second truncated cone-shaped portions 34, 36 that are joined by a sidewall segment 35, the sidewall 16 joined to a bottom wall 17 and provided with an open top 38. The smaller end of cup 12 is closed and sealed by bottom wall 17. The upper end of inner cup 12 curves with a cylindrical section having a wall portion 22 In one example, the angle of the truncated cones of outer cup 11 is equal to or less than that of inner cup 12. Inner cup 12 resides within outer cup 11. A gap 20 is provided between sidewalls 13 and 16 and between bottom wall 17 and 14. The promotional item is located in gap 20.

In another embodiment, gap 20, which holds the promotional item between cups 11 and 12, is essentially closed and thus, reduces heat transfer between the contents of cup assembly 10 and the surrounding environment (hereinafter "gap"). In a further embodiment, gap 20 may consist of a negative pressure (i.e. any pressure less than atmospheric pressure up to a perfect vacuum). For example, the negative pressure may be in the range of about 400 mbars to about 800 mbars, more specifically, from about 500 mbars to about 700 mbars. The maximum degree of negative pressure will be dependent on the plastic material and the thickness of the wall. Instead of air, the gap may be filled with other desired gases (e.g. nitrogen) and/or insulating liquids. In another embodiment, the gap may be occupied by an insulating material such as a foam, blowing agent, Styrofoam, and/or cardboard. In yet another embodiment, the promotional item can serve dual purposes—an insulating material and a promotional item. One example can be a Styrofoam promotional item. As such, the promotional item can be appropriately sized to fit within the gap and provide insulating ability.

In one embodiment, the container of the present invention is manufactured of an inexpensive material in order to create a disposable product. An example is that the present container is manufactured from a thermoplastic pliable material such as high density polyethylene. However, the container of the present invention can alternatively be manufactured from a variety of materials, including, but not limited to, thermoplastics such as polyolefins such as polypropylene and polyethylene, polyisoprene, polybutadiene, polybutene, polysiloxane, polycarbonates, polyamides, ethylene-vinyl acetate copolymers, ethylene-methacrylate copolymer, poly (vinyl chloride), polystyrene, polyesters, polyanhydrides, polyacrylianitrile, polysulfones, polyacrylic ester, acrylic, polyurethane and polyacetal, or copolymers or mixtures and other plastics used in food package applications or blends of the above.

FIG. 1 depicts an embodiment where the inner cup is has a rounded bottom and the outer cup has a substantially flat bottom to enable the dual walled cup to sit upright without external support. Subsequently, when a consumer desires to access the promotional item, the lower portion of the outer cup is separated (removed) from the inner cup of the dual walled structure. Consequently, removing the lower portion of the outer cup exposes the rounded bottom inner cup. The resultant cup, having the rounded bottom, is not stable—cannot sit upright without external support. As such, the cup is rendered substantially unusable.

In another embodiment, a pigment or dye is added to the present container. For example, the dye or pigment can be used to create a substantially opaque closure. As such, the opaque nature can help to protect the identity of the promotional item such as a prize or game piece contained in the present container.

Figure 6A:
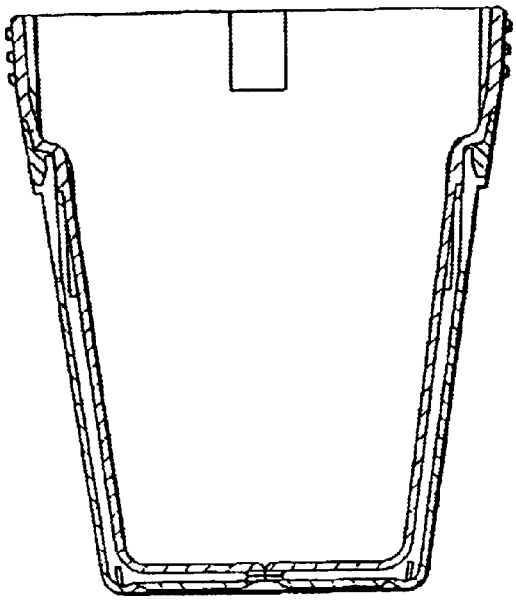
FIGS. 6A and 6B is another embodiment of the present invention exemplifying the over-mold ring where
Figure 6B:
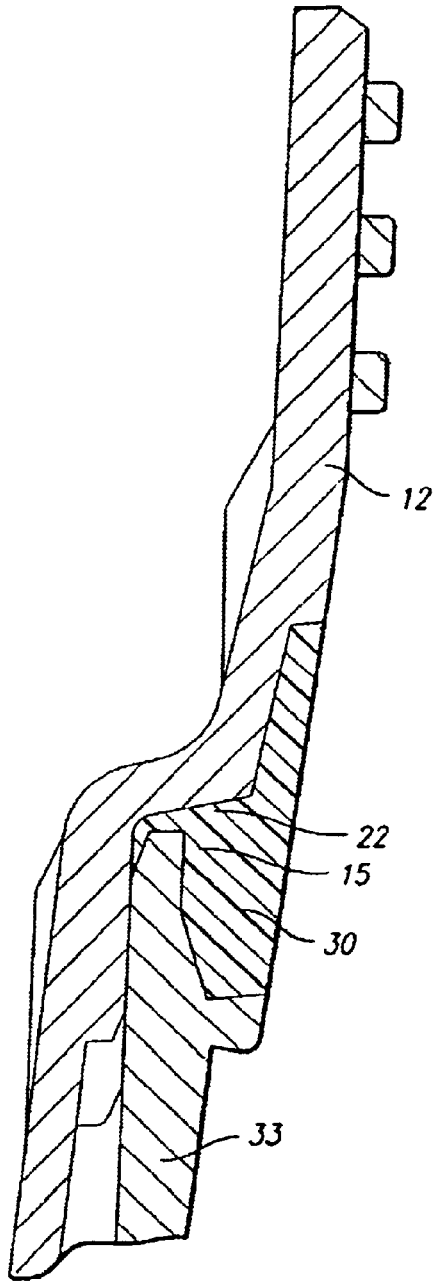

In a further embodiment shown in FIGS. 6A, and 6B, a ring 30 such as a layer and/or bead of plastic may be applied to the outer portion of the cup in the area of locations 15, 22 to further substantially seal the space between the inner and outer cups, shown at 15 and 22. This ring may further assist in preventing leakage of liquid into the air gap and thus, prevent a loss of insulation properties and a source for microbiological contamination. As well, this ring can also be used as a "tamper-evident" seal so as to prevent the container from being tampered with so as to access the promotional item. In one embodiment, ring 30 is applied as an "overmold ring." The term "overmold" is used as the conventional term is used for injection molding processes where a second layer of plastic is subsequently injected over a first layer of plastic.

However, it is understood that the method described below is one method and not meant to limit methods of applying the overmold ring. In another embodiment, the layer and/or bead may be applied by any conventional means including spun welding and/or sonic welding. The layer and/or bead may be composed of the same plastic as the other parts of the cup or of another plastic. For example, the layer and/or bead may be composed of a plastic that is softer and/or more resilient (e.g. a plastic with a higher elastomer content) so as to reduce slippage when hand held. In addition, in another example, the layer may be of a sufficient width so as to act as an additional grip when hand held.

The selection of the polymer, the size of the "gap" and/or the thickness of the inner and/or outer cups may affect the insulating ability of the container. Consequently, it is understood that a polymer with a lower thermal coefficient for a material, will result in a greater heat transmission rates as well. Material thickness will also affect the time sensitivity of a structure to heat loss. Thus, the thicker the material, the greater the time before heat loss begins. As well, an increase in the gap within limits should increase the insulation ability of the container.

The promotional item can take any desired shape so long as it fits within the space between the inner and outer cup (i.e. the gap). As such, the promotional item can take many shapes, forms, sizes and thicknesses. For example, the promotional item can be a molded article (e.g. toy, figurine), a label, a ticket (e.g. paper, plastic), a coin and/or an electronic device (e.g. a "smart chip", an RFID chip, or other small electronic devices).

In one embodiment, the promotional item is a game piece that is manufactured from many materials well known to those skilled in the art. For example, the game piece can be a cardboard with a glossy paper coating. Alternatively, the game piece can be manufactured from any of a variety of metal alloys, paper products, plastics, or other materials well known to those skilled in the art. In another example, the game piece is colored and marked with indicia related to the game being played. As such, the game piece can include the name of the promotional game and other promotional material are included on the opposite side of the game piece. In another example, the game piece can also contain a layer of opaque coating, which may be easily removed to reveal the markings and indicia of the game piece.

In FIG. 1, the gap between the inner and outer cup is enlarged to support the promotional material. The promotional is placed into the outer cup. The dual wall container of the present invention may be produced in a numerous ways. One way that the container of the present invention may be produced is illustrated in FIG. 7. In one embodiment, the inner and outer cups are formed in the same mold assembly and assembled either before the material is fully set or after the material is fully set. In step (1), which will be referred to as the "inner/outer cup plastic injection step," the inner cup (upper mold in FIG. 7) and the outer cup (lower mold in FIG. 7) are formed in the mold in the same step. Conventional injection plastic molding techniques may be used for the inner/outer plastic injection step. In step (2), the mold is opened and the promotional item is placed is placed in the outer cup within the mold. The mold piece corresponding with the inner cup is aligned with the mold piece corresponding with the outer cup containing the promotional item. In one method of aligning the molds in step (2) after the molds are opened, a hydraulic or pneumatic cylinder may be used to move either the mold containing the inner cup or the mold containing the outer cup in alignment with the opposite mold piece. In step (3), the mold is sufficiently closed so that the cups mate (i.e. inner cup is inserted into the outer cup or outer cup is brought over inner cup) but gap 20 is maintained between the cups so that the promotional item is maintained within the gap. And, in an optional procedure, step (3) may also include a process where an "overmold ring" is applied to the cup assembly, either before the inner and outer cups are fully set or after the cups are fully set, where a bead and/or layer of plastic is injected into the mold at or near the interface where the inner and outer cups meet (e.g. in the area of locations 15, 22) to further seal the space between the abutment of the inner and outer cups at location 15 and 22. An example of overmold ring 30 is shown in FIG. 6B. As such, after the ring is fully set, the ring forms a shrinkage fit with the cup. Subsequently, in step (4), the mold is opened and the multi-piece insulated cup of the present invention is ejected from the mold containing the promotional item. Examples of suitable ejection means include, but are not limited to, pop off devices and equivalent devices. The total cycle time may range, for example, between about 20 and about 40 seconds, in another embodiment, between about 25 and about 35 seconds. By employing this method, the shrinkage of the inner and outer cups, as the plastic cools, may result in a more efficient shrinkage fit of the inner and outer cups. It is understood that, rather than the "translation" motion (i.e. downward or upward motion) of the mold in step (2), the mold or molds may be moved in a "rotational" motion (i.e. circular motion).

In one embodiment of the method described above and detailed in FIG. 3, the inner cup is inserted into the outer cup before the material is fully set. And, in another embodiment, the overmold ring is applied to the cup assembly before the inner and outer cup material is fully set. In one example, the overmold ring is applied while the inner and outer cup are in the mold. In another example, the ring is applied after the cup assembly is ejected from the mold either before or after the material is fully set.

It is understood that the phrase "before the material is fully set" means that the plastic material are at a temperature between the glass transition temperature ("Tg") and the melting point ("Tm") of the material such that: (a) the cap assembly is rigid enough to retain their shape and be moved without damage; and (b) the sealing surfaces between the cup assembly and ring are warm enough to conform to each other to make the required leak-proof seal. Tg is the temperature below which the thermoplastic behaves like glass (i.e., the material is fully rigid and brittle). At or above Tg, the plastic is not as strong or rigid as glass, and is not brittle. And finally, above Tm, the plastic is a fluid melt. As a thermoplastic cools from Tm to Tg, it will shrink and increase in rigidity—a process known as "setting". When a plastic material is at a temperature between Tg and Tm, it is in a pliable/conformable state—i.e., not fully rigid, but of course not in a fluid state, which occurs at Tm. Tm and Tg values are widely published for commercial plastic materials. It is understood that each type of plastic may have its own Tg and Tm values.

In an embodiment, since it is important for efficiency of operation that the plastic flow from the extruder not be interrupted, the time available is limited for insertion of the promotional item without incurring a delay in the production cycle. This requires rapid action by the mechanism for inserting the promotional item into the mold. That is, the device that inserts the promotional item must get in between the mold halves quickly while they are open and get out quickly before the space between the closing mold halves becomes too small for the mechanism to be safely present therein.

In one specific embodiment of a fully automatic method of incorporating a promotional item into a dual walled cup, the promotional item is prepared for input into the system. In the next step, a robotic arm or other mechanism that can properly place the promotional item in the mold (e.g. "a pick and place) is employed. The mechanism picks-up the item and positions the item in the mold apparatus having transfer heads that engage and move the item. For example, transfer heads are connected to a drive mechanism that cycle the heads back and forth between an item pick up position and an item transfer position. The heads carry vacuum cups or other suitable mechanisms for engaging and holding items. Movement of the heads away from the pick up position pulls the item. The items are carried with the heads for subsequent placement in cavities in the mold sections.

In another embodiment, one or more liners are supplied to the mold (e.g. one to each mold half) in addition to the promotional item. These liners can be used for printing purposes, for insulation purposes (e.g. Styrofoam) or may be composed of one or more of the following: a composition containing an absorption material, a composition containing a releasing material, a composition containing an activation material, a barrier material, and/or a permeable material. For a detailed discussion of such liners and the method of inserting such liners, U.S. patent application Ser. No. 60/310,374 is hereby incorporated by reference herein.

Since it is also important for efficiency of operation that the plastic flow from the extruder not be interrupted, the time available is limited for insertion of liners on the walls of the mold halves without incurring a delay in the production cycle. This requires rapid action by the mechanism for inserting the liners on the walls of the mold halves. That is, the liner inserter must get in between the mold halves quickly while they are open and get out quickly before the space between the closing mold halves becomes too small for the mechanism to be safely present therein. As such, in one embodiment, the "pick and place" mechanism that is used to insert the promotional item into the mold can also be used to place the liner into the mold.

In one embodiment, the liner is placed on the core. The liner may be held in place in the mold by conventional methods known in the art such as suction or charging the film with static electricity or any combination of methods. Subsequently, the mold closes and plastic is injected into the mold. The mold then opens and the molded part is ejected with the liner attached to the plastic.

Figure 2:
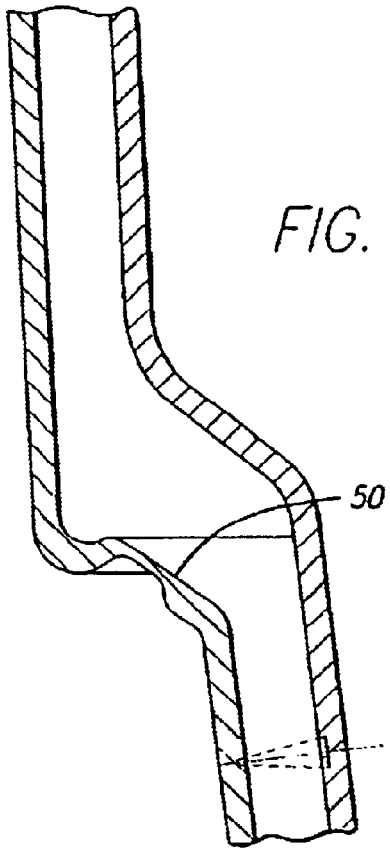
FIGS. 2 and 3 are exploded perspective views of one embodiment of the "break away" feature of FIG. 1.
Figure 3:
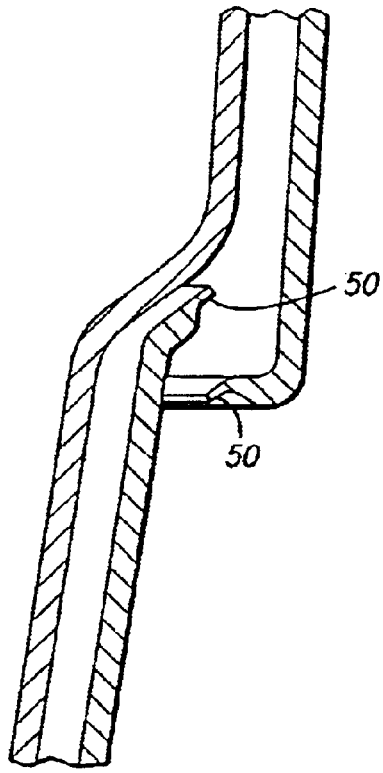

In a further embodiment, the promotional item is accessed by the consumer using a "break away" mechanism. In one embodiment, the "break away" mechanism can involve an outer wall that is composed of a thin walled section. FIGS. 2 and 3 are exploded perspective views of one embodiment of the "break away" feature of FIG. 1. FIGS. 2 and 3 exemplify various embodiments where the outer wall is composed of a thin walled section 50. As such, the outer cup can be broken along the thin walled section by such methods including, but not limited to, applying a twisting (shear) force, and/or applying a downward force to the outer cup. FIG. 3 exemplifies an embodiment showing the outer cup broken from the inner cup.

Figure 4A:
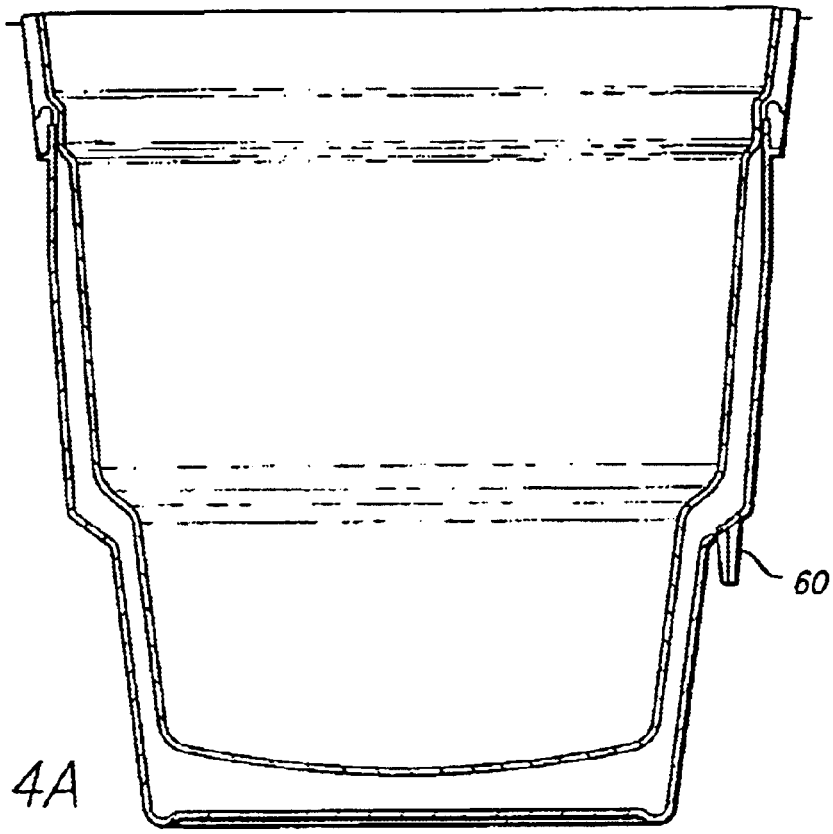
FIG. 4A is a vertical sectional cut-away view of one embodiment of the "pull-type" mechanism of the present invention.
Figure 4B:
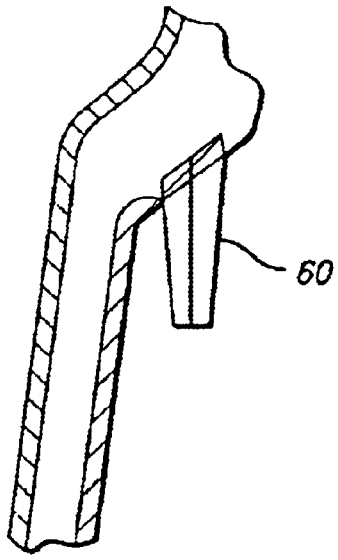
FIG. 4B is an exploded perspective view of one embodiment of the "pull-type" mechanism of FIG. 4A.
Figure 5:
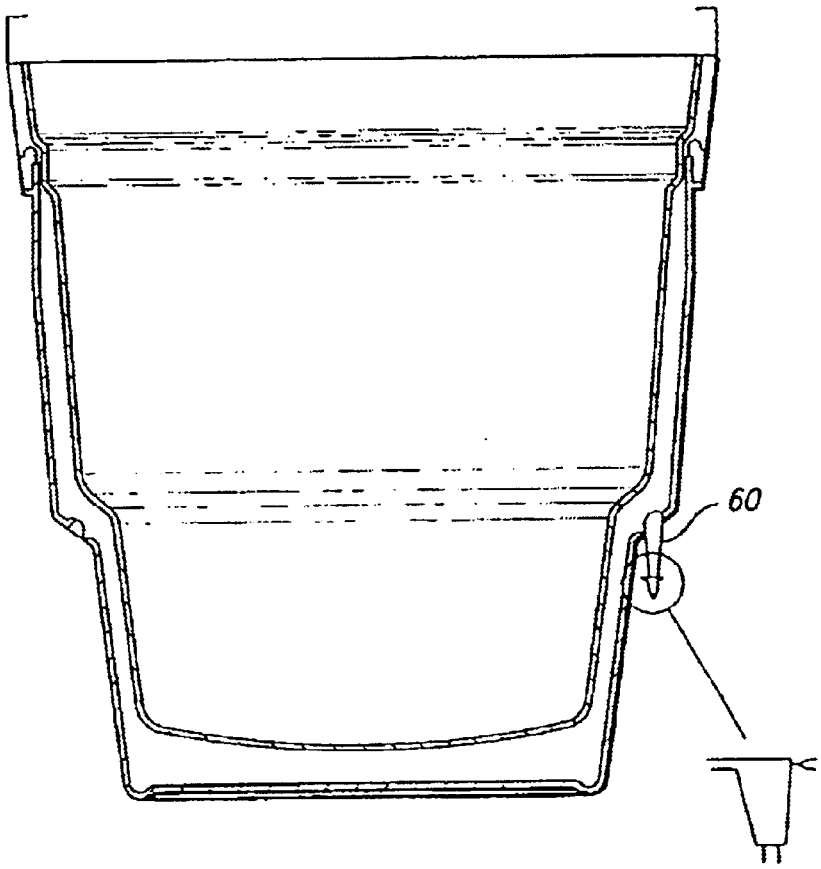
FIG. 5 is a vertical sectional cut-away view of another embodiment of the "pull-type" mechanism of the present invention.

In another embodiment of the "break away" mechanism of the present invention, a "pull tab" type of mechanism is utilized involving a "tear-off" type ring along a section of the outer cup. In one embodiment, the "pull tab" type mechanism and "tear-off" type ring may be similar to the "tamper-evident" ring that is commonly used on a plastic milk container. In one embodiment, the outer cup may be composed of LDPE or PP loaded with a calcium carbonate or other similar agent. FIGS. 4A, 4B and 5 exemplify embodiments of this "pull tab" type mechanism 60 and "tear-off" type ring. These figures are merely exemplary and are not meant to limit the design of the "break away" mechanism.

In another embodiment of the "break away" mechanism, the ring includes a "pull tab" 60. The ring, as seen in FIGS. 4A, 4B and 5 extends slightly outward from the outer perimeter of the ring. The pull tab 60 is connected to a flap. The flap is defined by perforations. The perforations form an open circle with the edges of the pull tab aligned with the perforations. The pull tab is located opposite the open, non-perforated portion of the open circle. One skilled in the art will readily recognize that the perforations and pull tab may also be configured in any number of combinations, shapes and sizes. The perforations aid the customer in opening the ring to reveal the promotional located within the gap of the inner and outer walls.

In another embodiment, the ring can be provided with a surface capable of receiving print. For example, indicia of any promotional item utilizing the present invention can be applied to one surface of the ring. In another example, any rules, regulations or other information can be conveyed on the other surface of the ring.

In one example of the present invention in use, the restaurants or retail stores provide the container of the present invention to each patron with a purchase of at least a drink or other beverage. After receipt of the container, a customer first consumes the drink or other beverage from the container. Subsequently, the customer breaks the cup by the intended "break away" feature to obtain the promotional item. For example, in one embodiment, the customer lifts the pull tab of the ring located on the container, and thereby tears the ring along the perforations as shown in FIG. 5. After tearing the ring, the customer can separate the inner and outer cups to reveal the promotional item. The customer can then remove the promotional item.

The present container provides a way to deliver a promotional item to a customer in an innovative and convenient way. The location of the promotional item within the container advantageously calls the customer's attention to the presence of the promotional item. The seal of the present container also keeps the promotional item hidden until opened. The seal thus helps to maintain the integrity of any promotional item and, in one embodiment, to ascertain the odds are accurate. Additionally, in another embodiment, the present container indicates tampering and protects the identity of the promotional item concealed within the container. In a further embodiment, the container is composed of a sufficiently "see-through" material so that the promotional item is visible to the consumer. Further, the present container ensures that only a specified number of promotional items are delivered to each customer with each container purchased or otherwise provided to the customer.

Although this invention has been described in terms of a certain preferred embodiment, other embodiments apparent to those of ordinary skill in the art are also within the scope of this invention.

In another aspect, the present invention provides a cup for holding a fluid for drinking,while enclosing a novelty article in a separate, selectively accessible compartment. The cup has a frustroconical body defined by a side wall. An open end receives therethrough a fluid for being contained within the body. A dome-shaped bottom wall in a lower portion of the body cooperates with the side wall to define a first cavity in the body for receiving and containing the fluid and to define a second cavity in the body which is open at the lower edge of the side wall for selective access into the second cavity. A cover closes the opening. A novelty article, being placed in the second cavity which is closed by the cover, is selectively accessed while the body functions for containing the fluid in the first cavity.

I claim:

1. A dual wall cup assembly comprising:

(a) an outer cup having a sidewall joined to a bottom wall and provided with an open top;

(b) an inner cup having a sidewall joined to a bottom wall and provided with an open top;

(c) the inner cup is configured to be receivable within the outer cup to create a sealed gap between the bottom walls of the outer and inner cups;

(d) a promotional item positioned within the gap; and (e) the bottom wall of the outer cup and at least a portion of the sidewall of the outer cup is opaque so that the promotional item is not visible.

2. The dual wall assembly of claim 1 wherein the sealed gap is also created between the side walls of an inner surface of the outer cup and an outer surface of the inner cup.

3. The dual wall assembly of claim 2 wherein the sidewall of the outer cup is opaque so that the promotional item is not visible.

4. The dual wall assembly of claim 2 wherein the promotional item is selected from the group consisting of a molded article, toy, figurine, ticket, coin and electronic device.

5. The dual wall assembly of claim 2 wherein the promotional item is a game piece.

6. The dual wall assembly of claim 2 wherein the bottom wall of an inner cup has dome-shape.

7. A dual wall cup assembly comprising:

(a) an outer cup having a sidewall joined to a bottom wall and provided with an open top;

(b) an inner cup having a sidewall joined to a bottom wall and provided with an open top;

(c) the inner cup is configured to be receivable within the outer cup to create a sealed gap between the bottom walls of the outer and inner cups;

(d) a promotional item positioned within the gap; and (e) a break-away mechanism along the sidewall of the outer cup so as to obtain the promotional item.

8. The dual wall assembly of claim 7 wherein the break-away mechanism utilizes a pull tab type of mechanism that includes a tear-off type ring along a section of the sidewall of the outer cup.

9. The dual wall assembly of claim 8, wherein the pull tab type of mechanism includes a ring that extends slightly outward from an outer perimeter of the ring.

10. The dual wall assembly of claim 8 wherein at least a portion of the sidewall of the outer cup that corresponds to the area of the sealed gap is opaque so that the promotional item is not visible.

11. The dual wall assembly of claim 10 wherein the sealed gap is also created between the side walls of an inner surface of the outer cup and an outer surface of the inner cup.

12. The dual wall assembly of claim 10 wherein the sidewall of the outer cup is opaque so that the promotional item is not visible.

13. The dual wall assembly of claim 10 wherein the promotional item is selected from the group consisting of a molded article, toy, figurine, ticket, coin and electronic device.

14. The dual wall assembly of claim 10 wherein the promotional item is a game piece.

15. The dual wall assembly of claim 10 wherein the bottom wall of an inner cup has a dome-shape.

* * * * *